US012378735B2

(12) United States Patent
Simmer et al.

(10) Patent No.: US 12,378,735 B2
(45) Date of Patent: Aug. 5, 2025

(54) AUTOMATIC MATERIAL FEED ADJUSTMENT SYSTEM

(71) Applicant: Caterpillar Paving Products Inc., Brooklyn Park, MN (US)

(72) Inventors: Jacob A. Simmer, Chaska, MN (US); Mathew J. Hedrington, Ham Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 811 days.

(21) Appl. No.: 17/698,768

(22) Filed: Mar. 18, 2022

(65) Prior Publication Data

US 2023/0295885 A1 Sep. 21, 2023

(51) Int. Cl.
*E01C 19/48* (2006.01)

(52) U.S. Cl.
CPC ..... *E01C 19/4873* (2013.01)

(58) Field of Classification Search
CPC ..... E01C 19/4873
USPC ..... 404/84.05–84.5, 118
See application file for complete search history.

(56) References Cited

U.S. PATENT DOCUMENTS 9,689,117 B2 6/2017 Bartoszek
10,494,772 B1 12/2019 Boston et al.
2014/0186115 A1* 7/2014 Graham ..... E01C 19/4873 404/75
2019/0323181 A1 10/2019 Exline
2020/0407925 A1* 12/2020 Hoisington ..... E01C 23/07
2021/0222377 A1* 7/2021 Schenkelberg ..... E01C 19/4893
2023/0382305 A1* 11/2023 Frantz ..... B60R 1/27

FOREIGN PATENT DOCUMENTS

CN 201817765 U 5/2011
CN 105908603 8 1/2018
JP 2017036540 A 2/2017

* cited by examiner

*Primary Examiner* — Raymond W Addie

(57) ABSTRACT

A paving machine includes a frame, a drive assembly including a steering mechanism, a hopper, a screed assembly, a material delivery system disposed on the frame and configured to transport a volume of paving material to the screed assembly, and a material feed adjustment system. The material delivery system includes a left conveyor having a left conveyor speed, a right conveyor having a right conveyor speed, a left auger having a left auger speed, and a right auger having a right auger speed. The material feed adjustment system includes a steering input sensor configured to transmit a steering angle of the steering mechanism, and a controller in electronic communication with the steering input sensor. The controller is configured to automatically control the left conveyor speed, the right conveyor speed, the left auger speed and the right auger speed based on the steering angle to maintain the target pile size.

20 Claims, 5 Drawing Sheets

AUTOMATIC MATERIAL FEED ADJUSTMENT SYSTEM

TECHNICAL FIELD

The present disclosure relates generally to a material feed adjustment system, and more particularly, to a material feed adjustment system for a paving machine.

BACKGROUND

Paving machines are used to lay and level a paving material, such as asphalt, on a ground surface for the construction of roads, bridges, parking lots, and other such surfaces. In general, paving machines include a chassis, a hopper for storing the paving material, an auger that distributes the paving material on a ground surface, and a screed assembly that compacts and levels the paving material to a desired mat thickness. An uneven or inconsistent distribution of paving material (e.g., asphalt concrete) in front of the screed may occur, for example, when the paving machine is turning, or otherwise deviates from a linear path, and the left and right sides of the paving machine are moving at different speeds.

Uneven or inconsistent distribution of paving material can be a result of paving material underflow and overflow conditions, that is, too little or too much paving material supplied in front of the screed by the auger(s) or segmented auger sets, respectively. Generally speaking, an underflow condition means not enough paving material is provided and a void in the paving material can be created at the screed, for instance, which means the screed can fall and create a divot in the road surface. An overflow condition means too much paving material is provided, which can cause the screed to climb and create a bump or high spot on the surface of the road. Thus, overflow or underflow conditions can affect the ability of the screed to produce a surface with a high-quality mat (e.g., a flat, smooth mat).

Prior art attempts to monitor and control distribution of paving material require measurement of paving material already placed in front of the screed. For example, U.S. Pat. No. 8,979,423 describes a material feed system including a screed, a conveyor and an auger. A sensor detects a volume of paving material placed in front of the screed, corresponding to a current material volume. This information may be compared with a target material volume, and a conveyor speed and auger speed are adjusted in order to reach, and maintain, the target material volume.

In light of the foregoing, a need exists for an improved material feed adjustment system for a paving machine.

SUMMARY

In accordance with one aspect of the present disclosure, a paving machine for paving a ground surface is disclosed. The paving machine may include a frame, a drive assembly including a steering mechanism, a hopper mounted on the frame, a screed assembly pivotally coupled to the frame, a material delivery system disposed on the frame and configured to transport a volume of paving material to the screed assembly, and a material feed adjustment system. The transported volume of paving material may form a target pile size of paving material adjacent the screed assembly. The material delivery system may include a left conveyor having a left conveyor speed, a right conveyor having a right conveyor speed, a left auger having a left auger speed, and a right auger having a right auger speed. The material feed adjustment system may include a steering input sensor and a controller. The steering input sensor may be coupled to the steering mechanism and configured to transmit a steering angle of the steering mechanism. The controller may be in electronic communication with the steering input sensor, and may be configured to receive the steering angle of the steering mechanism from the steering input sensor, and to automatically control the left conveyor speed, the right conveyor speed, the left auger speed and the right auger speed based on the received steering angle to maintain the target pile size.

In accordance with another aspect of the present disclosure, a material feed adjustment system for paving machine is disclosed. The paving machine may have a drive assembly including a steering mechanism, a screed assembly pivotally coupled to a frame of the paving machine, a material delivery system disposed on the frame and configured to transport a volume of paving material to the screed assembly. The transported volume of paving material may form a target pile size of paving material adjacent the screed assembly. The material delivery system may include a left conveyor, a right conveyor, a left auger and a right auger. The material feed adjustment system may include an image capturing device and a controller. The image capturing device may be coupled to the frame of the paving machine and may be configured to transmit a steering angle of the paving machine. The controller may be in electronic communication with the image capturing device, and may be configured to receive the steering angle of the steering mechanism from the image capturing device and to automatically control the left conveyor speed, the right conveyor speed, the left auger speed and the right auger speed based on the received steering angle to maintain the target pile size.

In accordance with yet another aspect of the present disclosure, a method of paving a ground surface using a paving machine is disclosed. The method may include activating a drive assembly of the paving machine. The drive assembly may include a prime mover and a steering mechanism. The method may further include propelling the paving machine using the drive assembly, and delivering, by a material delivery system disposed on a frame of the paving machine, a volume of paving material adjacent a screed assembly pivotally coupled to the frame. The material delivery system may include a left auger having a left auger speed, a right auger having a right auger speed, a left conveyor having a left conveyor speed and a right conveyor having a right conveyor speed. The method may further include detecting, by a steering input sensor coupled to the steering mechanism, a deviation in a steering angle of the steering mechanism; receiving, by a controller of the paving machine, the deviation in the steering angle of the steering mechanism; and adjusting, by the controller, the left auger speed, the right auger speed, the left conveyor speed and the right conveyor speed based on the deviation in the steering angle of the steering mechanism to maintain the volume of paving material delivered by the material delivery system.

These and other aspect and features of the present disclosure will be better understood upon reading the following detailed description when taken in conjunction with the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
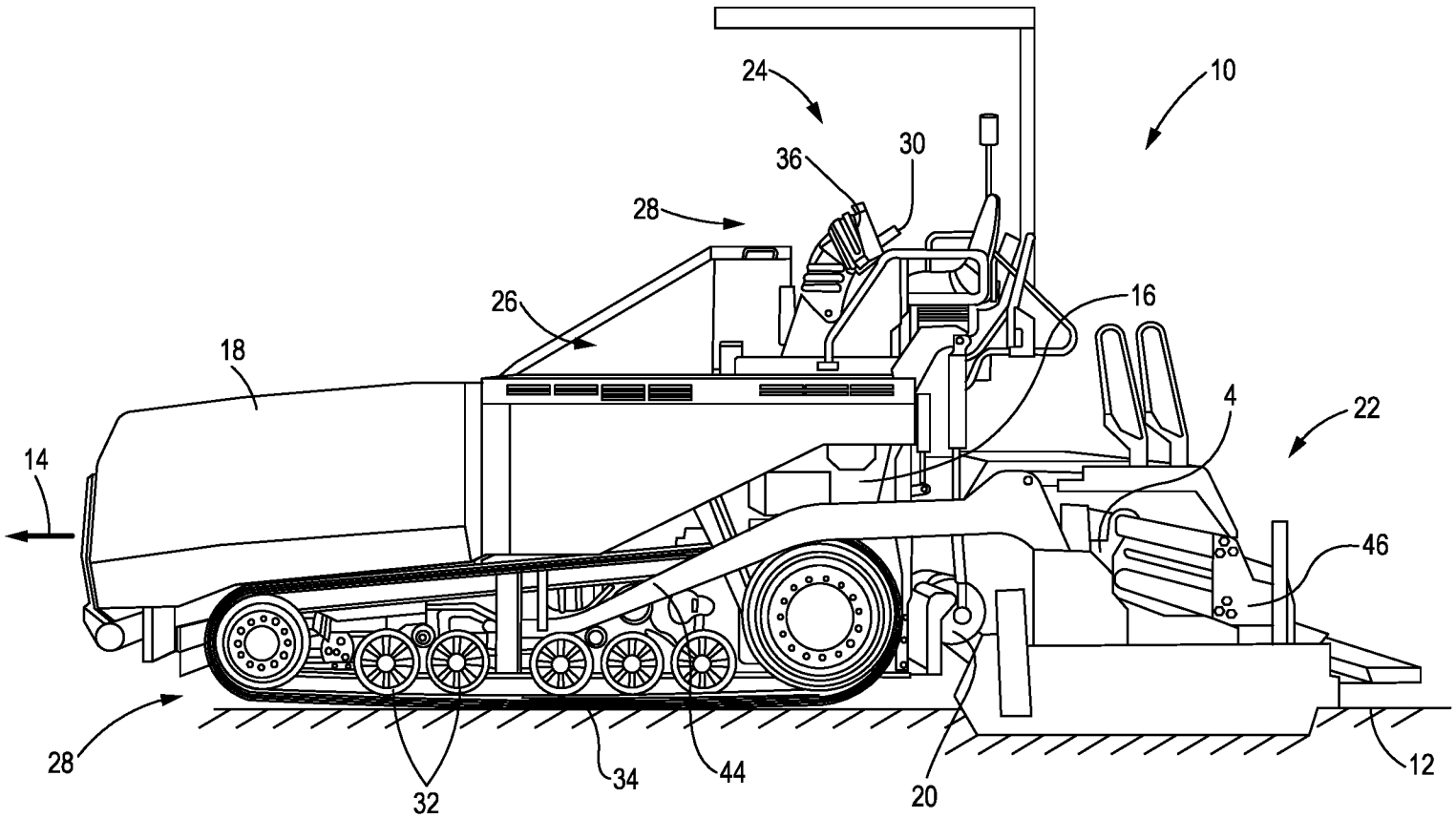
FIG. 1 is a side view of an exemplary paving machine, according to an embodiment of the present disclosure.

FIG. 1 illustrates a side view of an exemplary paving machine 10, according to an embodiment of the present disclosure. The paving machine 10 may be used to level and compact a paving material on a ground surface 12 to provide a layer of paved material. For the purposes of this disclosure, the term "ground surface" is broadly used to refer to all types of surfaces that form typical roadways (e.g., asphalt, cement, clay, sand, dirt, etc.) or upon which the paving material may be deposited in the formation of roadways. In the illustrated embodiment, the paving machine 10 is a track-equipped paver; however, in other embodiments, the paving machine may be wheel-equipped. As used herein, a "front" position refers to a frontward position on the paving machine 10 in a forward direction of travel 14, while a "rear" position refers to a rearward position on the paving machine 10 with respect to the direction of travel. The paving machine 10 generally includes a frame 16, a hopper 18, at least one auger 20, and a screed assembly 22. The paving machine 10 may also include an operator station 24, from which an operator may maneuver and control the paving machine. The paving machine 10 operator station 24 may include one or more seats 72 (FIG. 3) for an operator.

The hopper 18, mounted on the frame 16 adjacent the front end of the paving machine 10, stores paving material; and the auger 20, or other distributing device, distributes the paving material onto the ground surface 12. The screed assembly 22 is positioned to the rear of the auger 20, and levels and compacts the paving material delivered by the auger to the ground surface 12. The screed assembly 22 includes a main screed 42 movably mounted on the frame 16. More specifically, the main screed 42 is coupled to an end of a tow arm 44. An opposite end of the tow arm 44 may be pivotally connected to the frame 16 of the paving machine 10 in a manner for towing the screed assembly 22. The screed assembly 22 may pivot about the pivotal connection with the frame 16 to float freely over the ground surface 12 being paved. The screed assembly 22 may also include one or more screed extensions 46 movably coupled to the main screed 42. In one embodiment, the screed extensions 46 may be mounted rearwardly of the main screed 42; while in other embodiments, the screed extensions 114 may be mounted in front of the main screed, based on application requirements.

The paving machine 10 may be propelled by an engine assembly 26 including a prime mover (not shown) adapted to provide power to the paving machine 10 for operational and mobility requirements. The power source may be any power source known in the art, such as an internal combustion engine, batteries, motor, and so on. More specifically, the prime mover may power a drive assembly 28, including a steering mechanism 30 and one or more ground engaging mechanisms 34 adapted to support and provide maneuverability to the paving machine 10 on the ground surface 12. In the illustrated embodiments, the ground engaging mechanisms 34 include one or more idlers 32 and one or more tracks 34. In other embodiments, the ground engaging mechanisms may include wheels. The steering mechanism 30 may be a steering wheel, a steering dial, or other device that may be used by the operator to steer the paving machine. Additionally, the paving machine 10 may include one or more control panels 36, for example, positioned in the operator station 24. Each control panel 36 may be configured to receive various inputs from the operator, to control one or more aspects of the paving machine 10 via a controller 40 (FIG. 4) based on the operator inputs, and to display information to the operator during operation of the paving machine. For example, the operator of the paving machine may use the control panel 36 to control a rate of delivery of the paving material, adjust a height of the screed assembly 22, etc.

Figure 2:
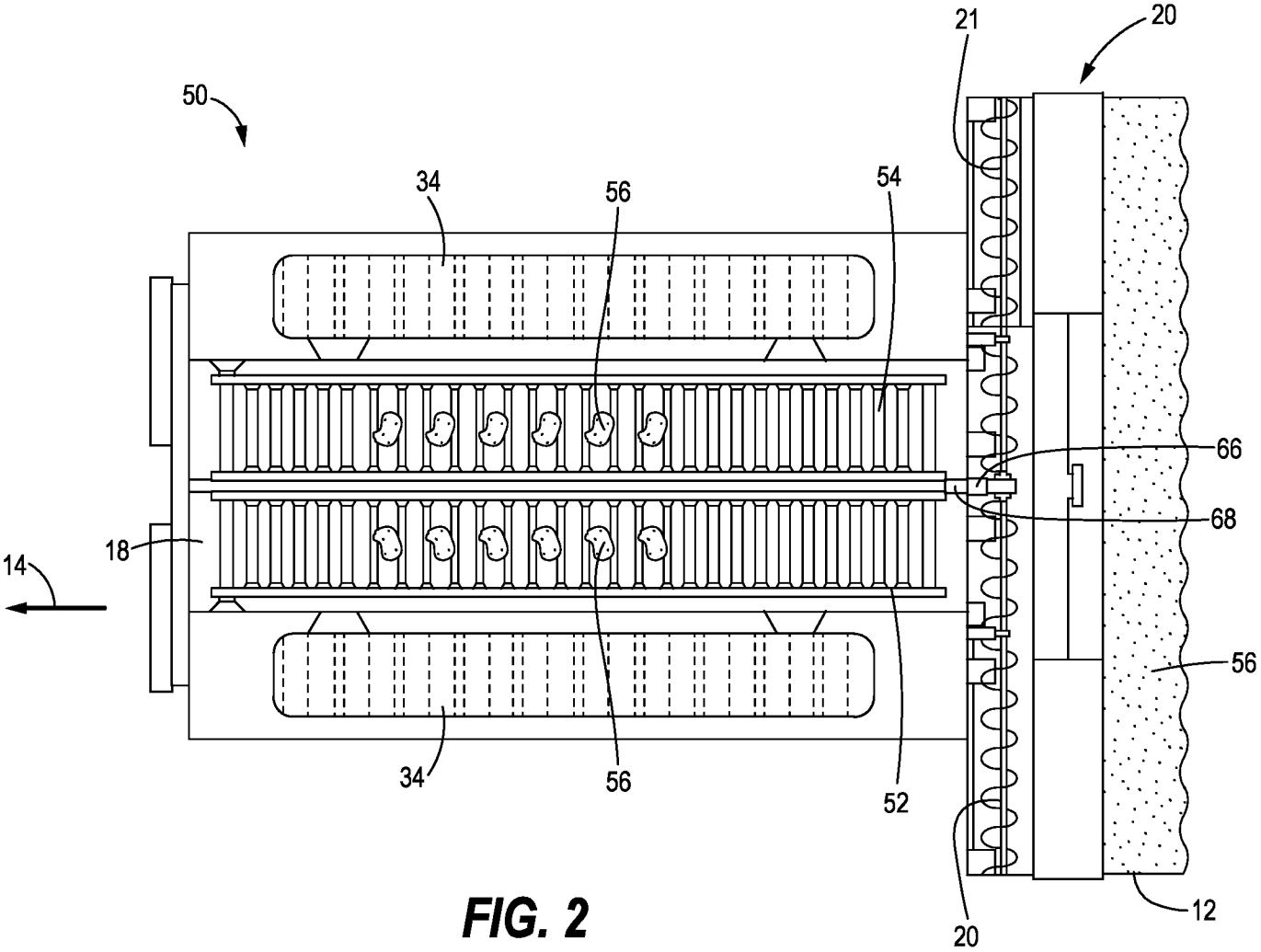
FIG. 2 is a top view of a portion of the exemplary paving machine of FIG. 1, according to an embodiment of the present disclosure.

The paving machine 10 also includes a material delivery system 50 mounted on the frame 16 of the paving machine. The material delivery system 50 is adapted to receive paving material on the paving machine 10 and to transfer the paving material from one portion of the paving machine to another. Referring to FIG. 2, the material delivery system 50 includes the hopper 18, a left conveyor 52, a right conveyor 54, a left auger 20, and a right auger 21. The hopper 18 may be adapted to hold a volume of paving material 56 therein received from an external source (not shown), such as a truck or transfer vehicle, for example. The left and right conveyors 52, 54 may be disposed parallel to each other, and may be controlled independently from one another by an operator of the paving machine 10 or automatically, as will be discussed further below.

The left conveyor 52 may transfer the paving material 56 from the hopper 18 to the left auger 20 in a direction generally parallel to a direction of travel 14 of the paving machine 10. The left conveyor 52 may be any conveying element known in the art, such as a belt type conveyor, a feeder bar type conveyor, and so on. The left auger 20 may be disposed rearwardly and adjacent to an end of the left conveyor 52, and may distribute the paving material 56 in front of the screed assembly 22 and laterally in a direction generally perpendicular to the direction of travel 14 of the paving machine 10. The left auger 20 may be any conveying element known in the art, such as a screw type conveyor, a rotating type conveyor, and so on.

In a similar manner, the right conveyor 54 transfers the paving material 56 from the hopper 18 to the right auger 21 in the direction generally parallel to the direction of travel 14 of the paving machine 10. The right conveyor 54 may be any conveying element known in the art, such as a belt type conveyor, a feeder bar type conveyor, and so on. The right auger 21 may be disposed rearwardly and adjacent to an end of the right conveyor 54, and may be adapted to distribute the paving material in front of the assembly 108 and laterally in the direction generally perpendicular to the direction of travel 14 of the paving machine 10. The right auger 21 may be any conveying element known in the art, such as a screw type conveyor, a rotating type conveyor, and so on.

Figure 4:
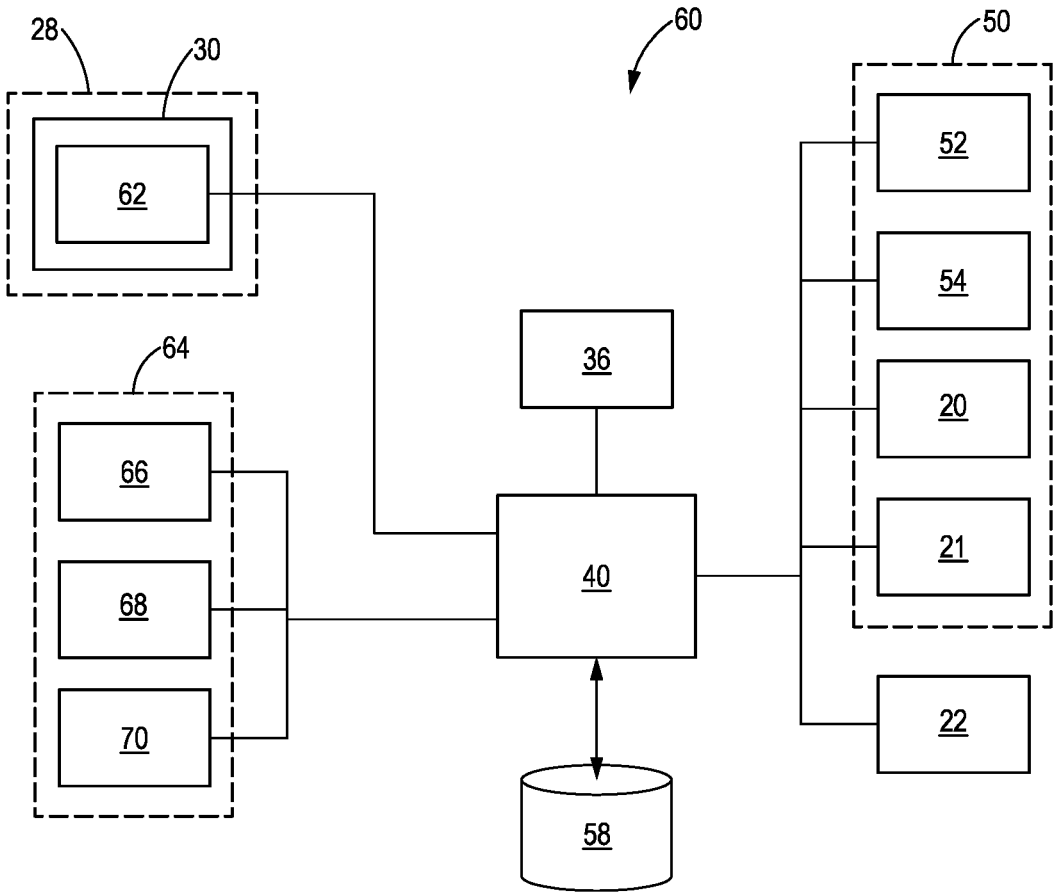
FIG. 4 is a block diagram of a material feed control system, according to an embodiment of the present disclosure.

The paving machine 10 may also include a material feed adjustment system 60, illustrated schematically in FIG. 4. The material feed adjustment system 60 may include the controller or electronic control module (ECM)) 40, that may be in electronic communication with a database 58, the control panel 36, a plurality of sensors (discussed in detail below), the components of the material delivery system 50 and the screed assembly 22. More specifically, the controller 40 may include any type of device that may interpret and/or execute information and/or instructions stored within a memory of the controller, in order to perform one or more functions. The memory of the controller 40 may include a RAM, a ROM, and/or another type of dynamic or static storage device (e.g., a flash, magnetic, or optical memory) that stores information and/or instructions for use by the controller. The controller 40 may also include a processor (e.g., a central processing unit, a graphics processing unit, an accelerated processing unit), a microprocessor, and/or any processing logic (e.g., a field-programmable gate array ("FPGA"), an application-specific integrated circuit ("ASIC"), etc.), and/or any other hardware and/or software.

As noted above, the controller 40 may be in electronic communication with a plurality of sensors. More specifically, a steering input sensor 62 may measure and transmit to the controller 40 a steering angle α of the paving machine 10. In one embodiment the steering input sensor 62 may be a position sensing cylinder (or other type of motion transducer) directly connected to the steering mechanism 30. In other embodiments, the steering input sensor 62 may include one or more smart cameras (not shown) aimed toward the screed assembly 22, the ground engaging mechanisms 34, a curb or edge of the ground surface 12 and/or another guidance line provided on the ground surface.

The controller 40 may also be in electronic communication with a prime mover speed sensor (not shown), which may transmit the propel speed of the prime mover to the controller. The controller 40 may also be in electronic communication with a plurality of material height sensors 64. Each material height sensor 64 may measure a height or a volume of paving material at various locations within the material delivery system 50 and adjacent the screed assembly 22. As used herein, the term "pile size" may refer to a height and/or volume of a pile of paving material. Each material height sensor 64 may be a contact type material feed sensor, such as a paddle type feed sensor; or a non-contact type material feed sensor such as a sonic type feed sensor, a laser or a smart camera. More specifically, the material height sensors 64 may include one or more auger material height sensors 66, one or more conveyor material height sensors 68, and a pair of screed material height sensors 70. The auger material height sensor 66 may be positioned proximate the left and right augers 20, 21 to monitor a height of the paving material 56 in the left and right augers. Similarly, the conveyor material height sensor 68 may be positioned proximate the left and right conveyors 52, 54, and may monitor a volume and/or a height of the paving material 56 that has been deposited on the ground surface 12 from each of the left and right conveyors. Finally, each screed material height sensor 70 may be positioned on the screed assembly 22, for example, at opposite distal ends of the screed extensions 46, and may monitor a pile size of the paving material 56 present directly in front of the screed assembly.

As illustrated in FIG. 4, the controller 40 is configured to selectively receive a signal indicative of a steering angle α of the paving machine 10 from the steering input sensor 62. Further, the controller 40 is configured to selectively receive signals indicative of a height of the paving material 56 in the left auger 20 and the right auger 21 from the auger material height sensor 66. The controller 40 is also configured to selectively receive signals indicative of a height of the paving material 56 deposited on the ground surface 12 by the left conveyor 52 and the right conveyor 54 from the conveyor material height sensor 68. The controller 40 is further configured to selectively receive a signal from each of the screed material height sensors 70 indicative of a pile size of paving material immediately in front of the screed assembly 22.

Based on the received steering angle α of the paving machine 10, and optionally the height of the paving material 56 deposited on the ground surface 12 by the left and right conveyors 52, 54, the height of the paving material in the left and right augers 20, 21, and the pile size adjacent the screed assembly, the controller 40 is further configured to control a speed of the left conveyor 52, the right conveyor 54, the left auger 20, and/or the right auger 21 independently, with respect to one another. In an alternative embodiment, the controller 40 is configured to control a rotational direction of the left auger 20 and/or the right auger 21. As such, as illustrated, the controller 40 is communicably coupled to each of the left auger 20, the left conveyor 52, the right auger 21 and the right conveyor 54. More specifically, in one embodiment, the controller 40 may be communicably coupled to an electronic displacement control unit (not shown) of a variable displacement piston pump (not shown) associated with each of the left auger 20, the left conveyor 52, the right auger 21 and the right conveyor 54. In another embodiment, the controller 40 may be communicably coupled to an electric motor (not shown) or other rotational actuator associated with each of the left auger 20, the left conveyor 52, the right auger 21 and the right conveyor 54.

INDUSTRIAL APPLICABILITY

In practice, the teachings of the present disclosure may find applicability in many industries including, but not limited to, construction and earth moving equipment. As one particular example, the present disclosure may be beneficial to paving machines. A basic operation of the paving machine is to lay down material uniformly and smoothly. The present disclosure provides a system to automatically adjust the amount of paving material being placed before the screed assembly of the paving machine when paving around corners or entering around a corner. Namely, the present disclosure analyzes a steering angle of the paving machine to adjust a speed of each conveyor and/or auger depending on the degree of the corner or curve. The present solution reduces the amount of time and energy the operator(s) must use to control the amount of paving material being deposited in front of the screed assembly, and enables the operator to focus on alternative tasks that must be performed while paving.

Figure 3:
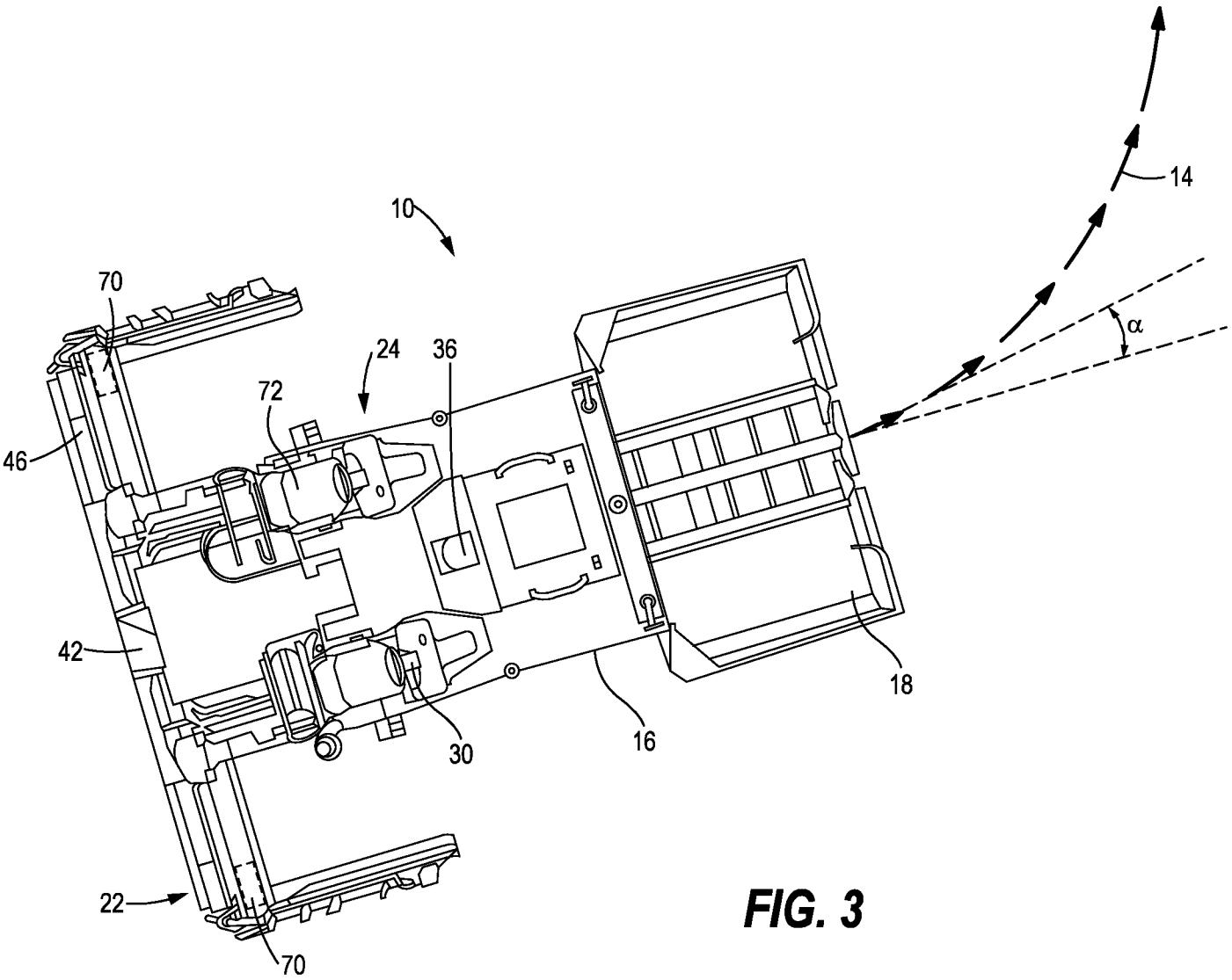
FIG. 3 is a top schematic view of the exemplary paving machine of FIG. 1, according to an embodiment of the present disclosure.

For example, FIG. 3 illustrates a top view of the paving machine 10 in motion. As shown, an operator of the paving machine 10 may direct the paving machine by rotating or otherwise adjusting a steering mechanism 30. Changing the steering angle α of the paving machine 10 causes a change in speed of the ground engaging mechanisms 34 (FIG. 1). For example, when turning left, the track 34 on the right side of the paving machine 10 may be propelled at a higher speed than the track on the left side of the paving machine. As the different sides of the paving machine 10 advance at different speeds, the material feed adjustment system 60 may adjust the speeds of the left auger 20, the left conveyor 52, the right auger 21 and/or the right conveyor 54 based on the steering angle α of the paving machine 10 to ensure a uniform and smooth paving surface as the paving machine proceeds through the curve or turn.

In one aspect, if the paving machine 10 is turning left or right, the controller 40 may receive the steering angle α sensed by the steering input sensor 62. Using the steering angle α, the controller 40 may adjust the speeds of the left auger 20, the left conveyor 52, the right auger 21 and the right conveyor 54, in order to deliver a proper volume of paving material proximate the screed assembly 22. For example, if turning left at steering angle α, as shown in FIG. 3, the controller 40 may reduce the speed of the left auger 20 and the left conveyor 52 to deliver a smaller volume of paving material adjacent the left side of the screed assembly 22, and may increase the speed of the right auger 21 and the right conveyor 54 to deliver a greater volume of paving material adjacent the right side of the screed assembly—thereby ensuring the ground surface 12 is evenly covered with the paving material 56 for the duration of the curve or turn. The magnitude at which the controller 40 reduces or increases the speeds of the augers 20, 21 and the conveyors 52, 54 depends directly on the magnitude of the steering angle α of the paving machine 10.

Figure 5:
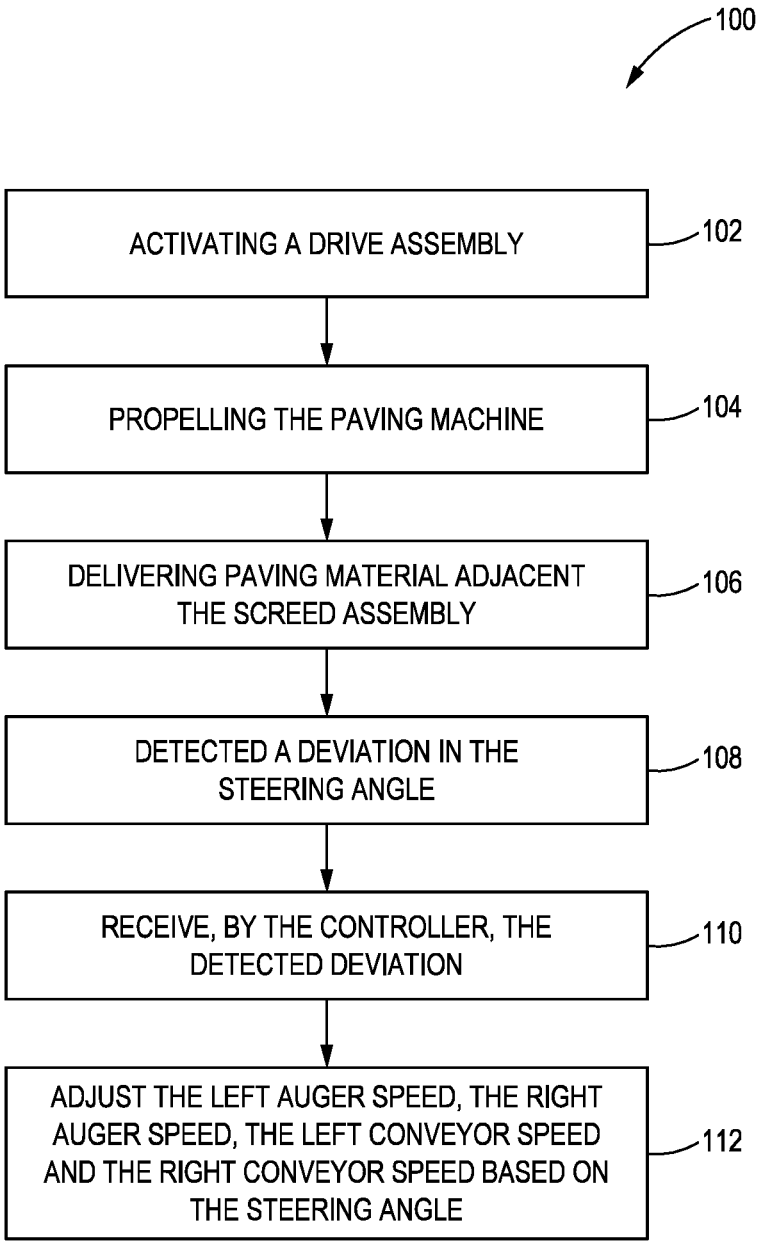
FIG. 5 is a flowchart illustrating a method of paving, according to an embodiment of the present disclosure.

A series of steps 100 involved in paving the ground surface 12 is illustrated in a flowchart format in FIG. 5. As shown therein, in a first step 102 the drive assembly 28 is activated by providing power to the prime mover. An operator of the paving machine 10 may then proceed to drive the paving machine in the forward direction 14 (step 102). The ground engaging mechanisms or tracks 34 may be propelled by the prime mover, for example.

While operating the paving machine 10 in an initial linear direction, for example, paving material may be delivered adjacent the screed assembly 22 (step 106). More specifically, paving material 56 may be transported by the left and right conveyors 52, 54 from the hopper 18 to the left and right augers 20, 21. The left auger 20 may then deliver a portion of the paving material adjacent the left side of the screed assembly 22, while the right auger 21 may deliver a portion of the paving material adjacent the right side of the screed assembly. The pair of screed material height sensors 70 may be used to confirm a target pile size has been reached. While proceeding in a linear direction of travel, the steering input sensor 62 may transmit a steering angle α of 0° to the controller 40.

In a fourth step 108, the steering input sensor 62 may detect a change in the steering angle α of the paving machine 10. For example, as mentioned above, when traveling in a linear direction, the steering angle α of the paving machine 10 may be 0°. As illustrated in FIG. 3, however, when the operator steers the paving machine 10 into a curve or makes a turn, the steering angle α of the paving machine 10 may have a value other than 0°. More specifically, the steering input sensor 62 may detect a change in the steering angle α of the steering mechanism 30, and may transmit the steering angle α value to the controller 40. The controller 40 may receive the transmitted steering angle α, and calculate new auger 20, 21 speeds and new conveyor speeds 52, 54 necessary to maintain a target pile size adjacent the screed assembly (step 110).

The controller 40 may then adjust the speed of the left conveyor 52 and the left auger 20 according to the value of the steering angle α to ensure the target pile size is maintained. Namely, the left conveyor 52 and the left auger 20 operate at a predetermined speed ratio. As such, the speeds of the left conveyor 52 and the left auger 20 may be reduced or increased, but should maintain the predetermined speed ratio. Similarly, the controller 40 may adjust the speed of the right conveyor 54 and the right auger 21 according to the value of the steering angle α to ensure the target pile size is maintained. The right conveyor 54 and the right auger 21 also operate at a predetermined speed ratio. As such, the speeds of the right conveyor 54 and the right auger 21 may be reduced or increased, but the predetermined speed ratio will be maintained. In an alternative embodiment, the method 100 may further include detecting heights of paving material by the plurality of material height sensors 64. Each of the material height sensors 64 may transmit their respective data to the controller 40, which may use the sensed data along with the steering angle to adjust the speeds of the conveyors 52, 54 and augers 20, 21.

While aspects of the present disclosure have been particularly shown and described with reference to the embodiments above, it will be understood by those skilled in the art that various additional embodiments may be contemplated by the modification of the disclosed machines, systems and assemblies without departing from the scope of what is disclosed. Such embodiments should be understood to fall within the scope of the present disclosure as determined based upon the claims and any equivalents thereof.

What is claimed is:

1. A paving machine for paving a ground surface, the paving machine comprising:
- a frame;
- a drive assembly including a steering mechanism;
- a hopper mounted on the frame;
- a screed assembly pivotally coupled to the frame;
- a material delivery system disposed on the frame and configured to transport a volume of paving material to the screed assembly, the transported volume of paving material forming a target pile size of paving material adjacent the screed assembly, the material delivery system including a left conveyor having a left conveyor speed, a right conveyor having a right conveyor speed, a left auger having a left auger speed, and a right auger having a right auger speed; and
- a material feed adjustment system, including:
  - a steering input sensor coupled to the steering mechanism and configured to transmit a steering angle of the steering mechanism; and
  - a controller in electronic communication with the steering input sensor, the controller configured to receive the steering angle of the steering mechanism from the steering input sensor, and to automatically control the left conveyor speed, the right conveyor speed, the left auger speed and the right auger speed based on the received steering angle to maintain the target pile size.

2. The paving machine of claim 1, wherein the steering mechanism is a steering wheel or a steering dial.

3. The paving machine of claim 1, wherein the controller is further configured to automatically control a height of the left auger from the ground surface and a height of the right auger from the ground surface based on the received steering angle to maintain the target pile size.

4. The paving machine of claim 1, wherein the controller is further configured to automatically control a rotational direction of the left auger or the right auger based on the received steering angle to maintain the target pile size.

5. The paving machine of claim 1, wherein the steering input sensor is a motion transducer type sensor.

6. The paving machine of claim 5, wherein the steering input sensor is a position sensing cylinder.

7. The paving machine of claim 1, wherein the drive assembly further includes a prime mover configured to propel the paving machine at a propel speed, the prime mover including a speed sensor configured to transmit the propel speed to the controller.

8. The paving machine of claim 7, wherein the controller is in electronic communication with the speed sensor, the controller configured to receive the propel speed from the speed sensor and to automatically control the left conveyor speed, the right conveyor speed, the left auger speed and the right auger speed based on the received propel speed to maintain the target pile size.

9. A material feed adjustment system for paving machine having a drive assembly including a steering mechanism, a screed assembly pivotally coupled to a frame of the paving machine, a material delivery system disposed on the frame and configured to transport a volume of paving material to the screed assembly, the transported volume of paving material forming a target pile size of paving material adjacent the screed assembly, the material delivery system including a left conveyor, a right conveyor, a left auger and a right auger, the material feed adjustment system comprising:

an image capturing device coupled to the frame of the paving machine and configured to transmit a steering angle of the paving machine; and a controller in electronic communication with the image capturing device, the controller configured to receive the steering angle of the steering mechanism from the image capturing device, and to automatically control a left conveyor speed, a right conveyor speed, a left auger speed and a right auger speed based on the received steering angle to maintain the target pile size.

10. The material feed adjustment system of claim 9, wherein the image capturing device is a smart camera.

11. The material feed adjustment system of claim 9, further including a plurality of material height sensors configured to transmit a current volume of paving material transiting the material delivery system and a current pile size of paving material adjacent the screed assembly.

12. The material feed adjustment system of claim 11, wherein the controller is in electronic communication with the plurality of material height sensors, the controller configured to receive the current volume of paving material transiting the material delivery system and the current pile size from the plurality of material height sensors, and to automatically control the left conveyor speed, the right conveyor speed, the left auger speed and the right auger speed based on the received current volume of paving material transiting the material delivery system and the current pile size.

13. The material feed adjustment system of claim 11, wherein each of the plurality of material height sensors is a sonic sensor, a contact sensor, a laser or a smart camera.

14. The material feed adjustment system of claim 11, wherein the plurality of material height sensors include a conveyor material height sensor coupled to the frame adjacent the left conveyor and the right conveyor, an auger material height sensor coupled to the frame adjacent the left auger and the right auger, and a screed material height sensor coupled to a distal end of the screed assembly.

15. The material feed adjustment system of claim 14, wherein the conveyor material height sensor is configured to measure a current volume of paving material present on the left conveyor and the right conveyor, wherein the auger material height sensor is configured to measure a current volume of paving material present adjacent the left auger and the right auger, and wherein the screed material height sensor is configured to measure the current pile size of paving material adjacent the screed assembly.

16. A method of paving a ground surface using a paving machine, the method comprising:

activating a drive assembly of the paving machine, the drive assembly including a prime mover and a steering mechanism;

propelling the paving machine, using the drive assembly;

delivering, by a material delivery system disposed on a frame of the paving machine, a volume of paving material adjacent a screed assembly pivotally coupled to the frame, the material delivery system including a left auger having a left auger speed, a right auger having a right auger speed, a left conveyor having a left conveyor speed and a right conveyor having a right conveyor speed;

detecting, by a steering input sensor coupled to the steering mechanism, a deviation in a steering angle of the steering mechanism;

receiving, by a controller of the paving machine, the deviation in the steering angle of the steering mechanism; and adjusting, by the controller, the left auger speed, the right auger speed, the left conveyor speed and the right conveyor speed based on the deviation in the steering angle of the steering mechanism to maintain the volume of paving material delivered by the material delivery system.

17. The method of claim 16, wherein the adjusting further includes increasing or decreasing the left auger speed, the right auger speed, the left conveyor speed, and the right conveyor speed by an amount proportional to the deviation in the steering angle of the steering mechanism.

18. The method of claim 16, wherein the adjusting further includes increasing or decreasing the left auger speed and the left conveyor speed at the same time to maintain a left side speed ratio between the left auger speed and the left conveyor speed, and increasing or decreasing the right auger speed and the right conveyor speed at the same time to maintain a right side speed ratio between the right auger speed and the right conveyor speed.

19. The method of claim 16, further including:

detecting, by a plurality of material height sensors coupled to the screed assembly, the volume of paving material adjacent the screed assembly;

receiving, by a controller of the paving machine, the volume of paving material adjacent the screed assembly; and adjusting, by the controller, the left auger speed, the right auger speed, the left conveyor speed and the right conveyor speed based on the deviation in the steering angle of the steering mechanism to maintain the volume of paving material delivered by the material delivery system.

20. The method of claim 16, wherein the deviation in the steering angle of the steering mechanism indicates the paving machine has deviated from a linear path of travel.

* * * * *